US005094283A

United States Patent [19]

Lawrence

[11] Patent Number: 5,094,283

[45] Date of Patent: Mar. 10, 1992

[54] GOLF CLUB HEAD COVER WITH ARTICLE STORAGE POCKET

[76] Inventor: Philip Lawrence, 359 Cornell Rd., Westport, Mass. 02790

[21] Appl. No.: 605,244

[22] Filed: Oct. 29, 1990

[51] Int. Cl.[5] ..... A63B 57/00

[52] U.S. Cl. ..... 150/160; 206/315.4; 206/351.5

[58] Field of Search ..... 150/159, 160; 206/315.2-315.9; D21/221

[56] References Cited

U.S. PATENT DOCUMENTS

| | | | |
|---|---|---|---|
| D. 198,093 | 4/1964 | Bates | D21/221 |
| D. 202,199 | 9/1965 | Bates | D21/221 |
| 1,562,030 | 11/1925 | Lawrence | 206/315.4 |
| 1,570,510 | 1/1926 | McQuirk | 206/315.4 |
| 1,795,880 | 3/1931 | Mullins | 206/315.4 X |
| 1,939,488 | 12/1933 | Dent et al. | 206/315.4 X |
| 2,737,394 | 3/1956 | Abel | 150/160 X |
| 2,866,490 | 12/1958 | Thompson | 206/315.4 |
| 2,925,840 | 2/1960 | Hird | 150/160 X |
| 2,985,212 | 5/1961 | Dozier | 206/315.4 X |
| 3,055,409 | 9/1962 | Latina | 150/160 |
| 3,133,577 | 5/1964 | Bellevue, Sr. | 150/160 |
| 3,295,236 | 1/1967 | Wishnia | 150/160 X |
| 3,574,963 | 4/1971 | Rosenow | 150/160 X |
| 3,645,022 | 2/1972 | Anderson | 150/160 X |
| 4,213,614 | 7/1980 | Philippi | 150/160 X |
| 4,286,639 | 9/1981 | Murphy | 383/86 X |
| 4,296,787 | 10/1981 | Barton | 150/160 |
| 4,368,768 | 1/1983 | Cunko | 150/160 |
| 4,420,024 | 12/1983 | Clayton | 206/315.4 |
| 4,796,789 | 1/1989 | Willocks | 206/315.4 X |
| 4,905,827 | 3/1990 | Kim | 206/315.6 X |

FOREIGN PATENT DOCUMENTS

| | | | |
|---|---|---|---|
| 527306 | 10/1940 | United Kingdom | 206/315.3 |
| 1277431 | 6/1972 | United Kingdom | 206/315.3 |

*Primary Examiner*—Sue A. Weaver
*Attorney, Agent, or Firm*—William B. Ritchie

[57] ABSTRACT

A golf club head cover includes a pocket for storing tees, markers, scorecards, pencils, balls, or other small, useful items, and a sleeve for protecting the head of the golf club.

6 Claims, 3 Drawing Sheets

GOLF CLUB HEAD COVER WITH ARTICLE STORAGE POCKET

FIELD OF THE INVENTION

The invention relates in general, to golf club head covers, and, more particularly, to a golf club head cover providing a pocket for storing tees, markers, or other small, useful items.

BACKGROUND OF THE INVENTION

Essential equipment to any golfer, aside from a golf culb and a golf ball, are tees and markers. These inexpensive and small devices are usually stored in a golfer's bag and are accessed from the bag as they are needed. This arrangement has limited usefulness because quite often the golfer does not have his golf bag to access those devices as, for instance, on a driving range where golf bags are prohibited. Also, as these devices often become misplaced, lost, or discarded during a golf outing, the golfer usually goes through several tees while playing on any one golf course. Thus, it becomes an inconvenience to continually bend down to the golf pouch and retrieve these small devices. It would be more convenient and more practical to store these devices with the golf club than to store them with the golf bag. Since many golfers use golf club covers to protect their clubs and since the covers are usually on the clubs at all times except for when the clubs are being used, such covers would serve as an ideal place to store tees, markers and/or other small, useful items.

Golf club head covers have been proposed in the past to protect the heads of golf clubs. Such covers have also been adapted with pockets. U.S. Pat. Nos. 3,574,963 and 3,295,236 disclose a cover with a pocket having an opening therein for holding and viewing an indicia to show the club type. Also, U.S. Pat. No. 4,368,768 discloses a cover having a longitudinal pocket hook and loop type of fastener (such as VELCRO) for securing a rigid member within the cover such that the cover can be fixedly attached to a golf bag. The prior art does not provide a pocket adapte for storing small, useful items.

It is, therefore, an object of this invention to provide golfers with an easier access to and a more practical storage place for tees, markers and other small, useful items which are frequently used while golfing.

It is a further object of this invention to provide golfers with a golf club head cover having a pocket which can store tees, markers and other small objects.

SUMMARY OF THE INVENTION

The present invention comprises an elongated sleeve having an bottom end, opened, such that the head portion of a golf club can be extended therethrough, a top end, closed, such that the golf club is contained within the sleeve, and a pocket having an upper lid and a lower lid. The upper lid and lower lid are attached to the sleeve such that there is an opening between the upper lid and the lower lid permitting insertion of objects between the upper lid and lower lid and removal of objects contained therebetween. The pocket may be located at the top end of the sleeve or anywhere along the sleeve between the top end and the bottom end.

BRIEF DESCRIPTION OF THE DRAWINGS

For a better understanding of the present invention, reference is made to the following detailed description of two exemplary embodiments considered in conjunction with the accompanying drawings, in which.

DETAILED DESCRIPTION OF THE INVENTION

Figure 1:
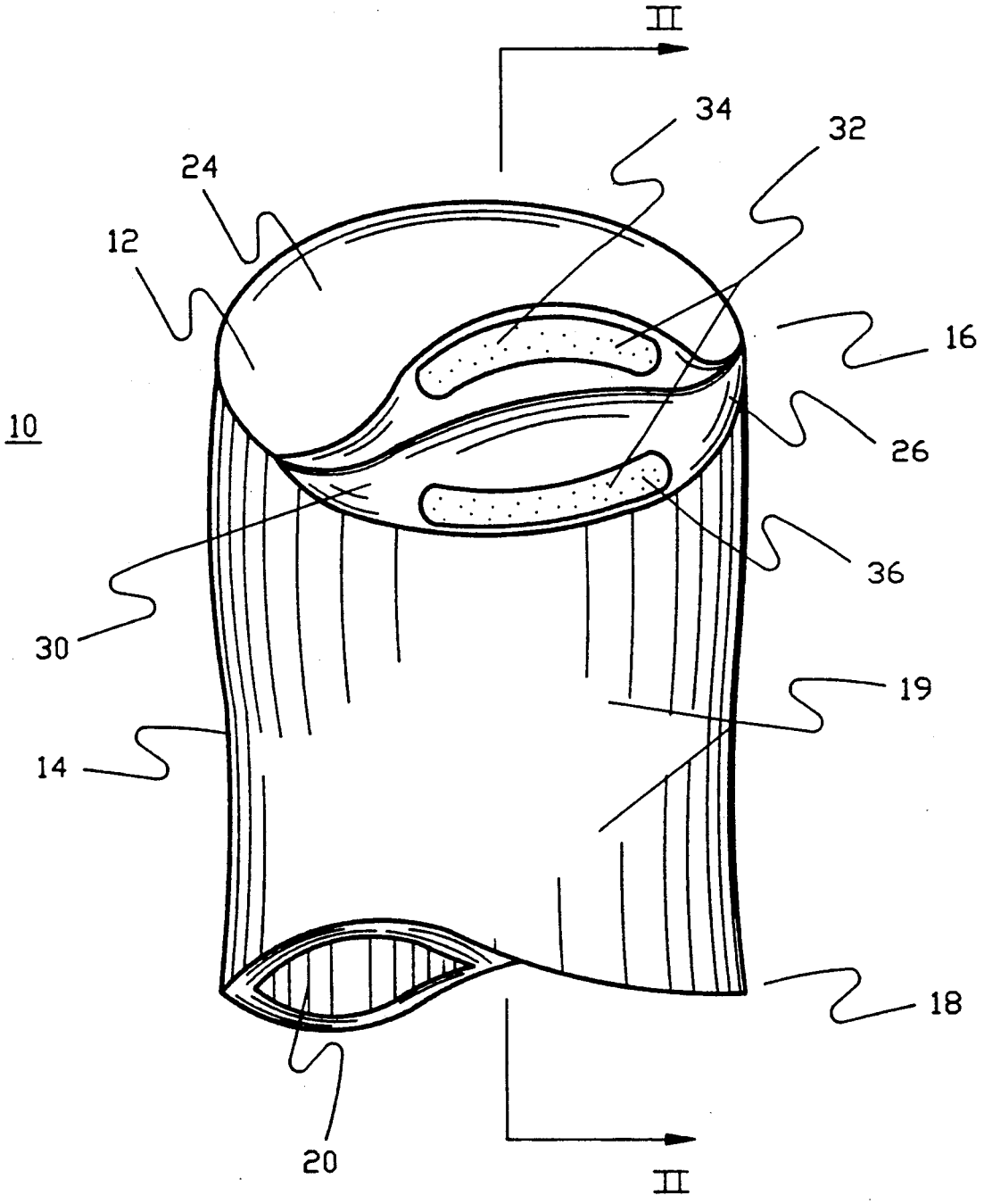
FIG. 1 is a front perspective view of a golf club head cover constructed in accordance with an exemplary embodiment of the present invention, the cover being shown with a pocket in an "open" position.

FIG. 1 illustrates a golf club head cover 10 having a pocket 12 thereon for storing golf tees, markers, pencils, scorecards or other small, useful items, and a cylindrical sleeve 14 for protecting the head of a golf club. The sleeve 14 includes a top end 16, a bottom end 18, and a body 19, such that there is a cavity 20 extending through the body 19 from the top end 16 to the bottom end 18. The diameter of the cavity 20 being large enough to allow insertion of the golf club head into the body 19 of the sleeve 14 and small enough to snugly grip the golf club head and prevent the cover 10 from falling off. The sleeve 14 can be composed of any flexible material that can be placed over the golf club head without causing damage to the club; such as, for example leather, cotton, polyester or nylon.

Although FIGS. 1–4 illustrate the sleeve 14 having a circular cross section, the shape of the sleeve 14 can be varied to accommodate different sized golf club heads. The length of the sleeve 14 can also be varied to accommodate different lengths of the shaft of the golf club.

The pocket 12 is circular in shape and is attached along its circumference around the top end 16 of the sleeve 14, such that a seal is created between the sleeve 14 and the pocket 12 thereby restraining the golf club head within the sleeve 14. The pocket 12 includes an upper lid 24, a lower lid 26, and a hook and loop type fastener (hereinafter h & l) 32 for temporarily fastening the upper lid 24 to the lower lid 26. While the lower lid 26 is completely attached to the sleeve 14, the upper lid 24 is conjointly attached to a substantial portion of the lower lid 26, such that there an opening 30 into which small objects can be placed. The upper lid 24 and the lower lid 26 can be varied in shape and size to accommodate sleeves of different shape and dimension. Also, the size of the opening 30 can be varied to accommodate larger or smaller items.

Figure 3:
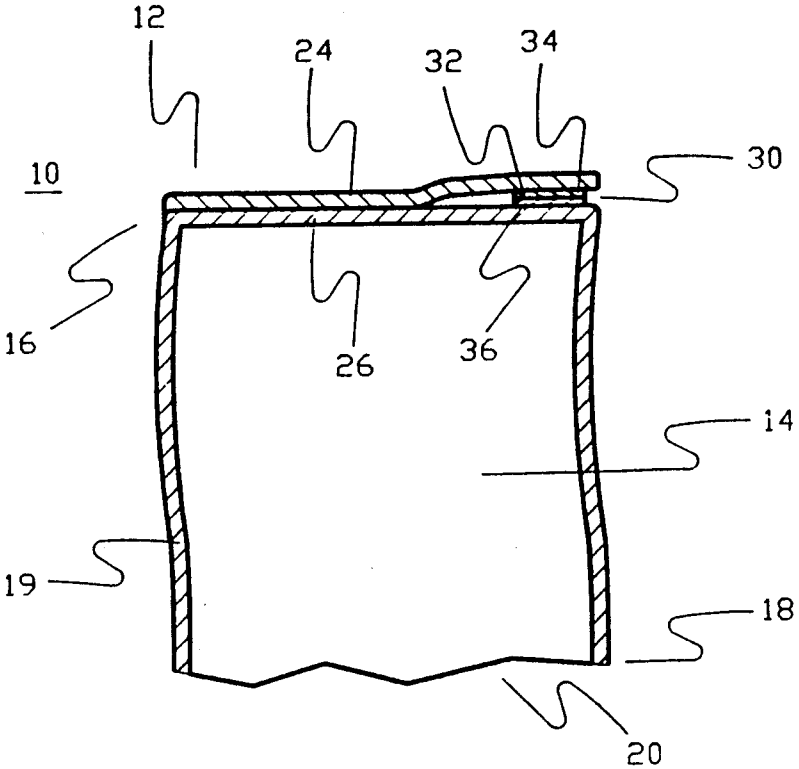
FIG. 3 is a cross-section view of the golf club head cover illustrated in FIG. 2, the cover being shown with the pocket in a "closed" position.
Figure 2:
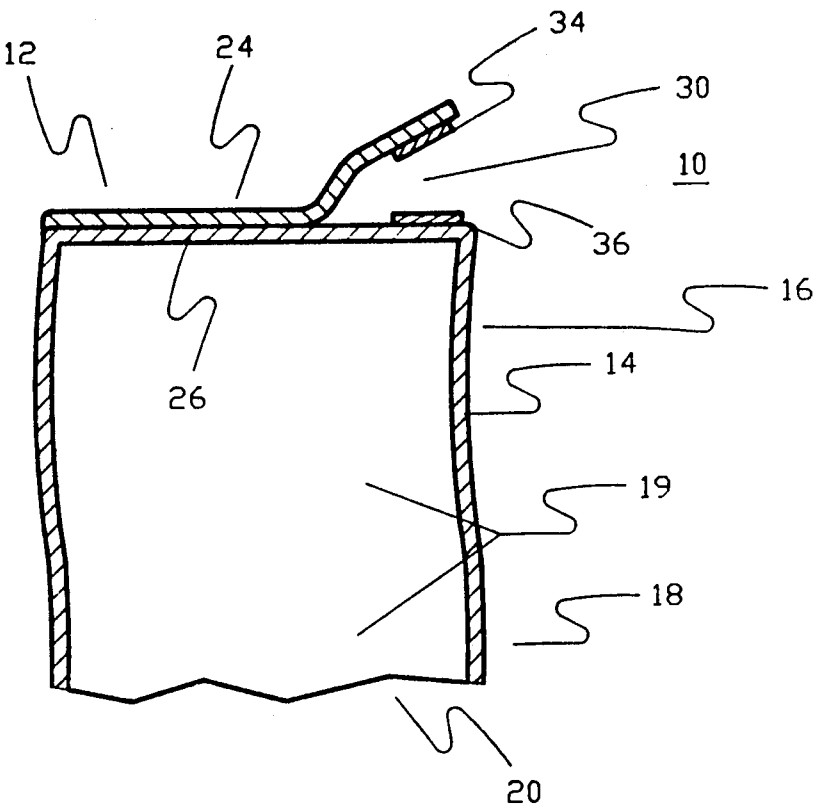
FIG. 2 is a cross-section view, taken along line II—II of FIG. 1 and looking in the direction of the arrows, of the golf club head cover illustrated in FIG. 1, the cover being shown with the pocket in an "open" position.

In the preferred embodiment as shown generally by FIGS. 1–3, the upper lid 24 is removably attached to the lower lid 26 at the opening 30. FIG. 3 shows the pocket 12 in a "closed" position such that the upper lid 24 is attached to the lower lid 26. In such a "closed" position, items can be stored between the upper lid 24 and the lower lid 26 such that the items cannot fall out of the opening 30 and become lost when the cover 10 is being used.

FIGS. 1 and 2 show the pocket 12 in an "open" position such that the upper lid 24 is detached from the lower lid 26. In such an "open" position, items can be inserted or removed through the opening 30 between the upper lid 24 and the lower lid 26.

The h & l zipper 32 includes an upper h & l 34 and a lower h & l 36. The upper h & l 34 is attached to the upper lid 24 of the pocket 12 at the opening 30 and the lower h & l 36 is attached to the lower lid 26 at the opening 30 in the same axial plane as the upper h & l 34 such that the upper h & l 34 can be repeatedly attached and detached from the lower h & l 36, thereby "opening" and "closing" the pocket 12. It should be noted that a standard metal or plastic zipper, a snap or series of snaps, or other similar fastening mechanisms could be used in place of the h & l zipper 32 to achieve the same "opening" and "closing" effect.

Figure 4:
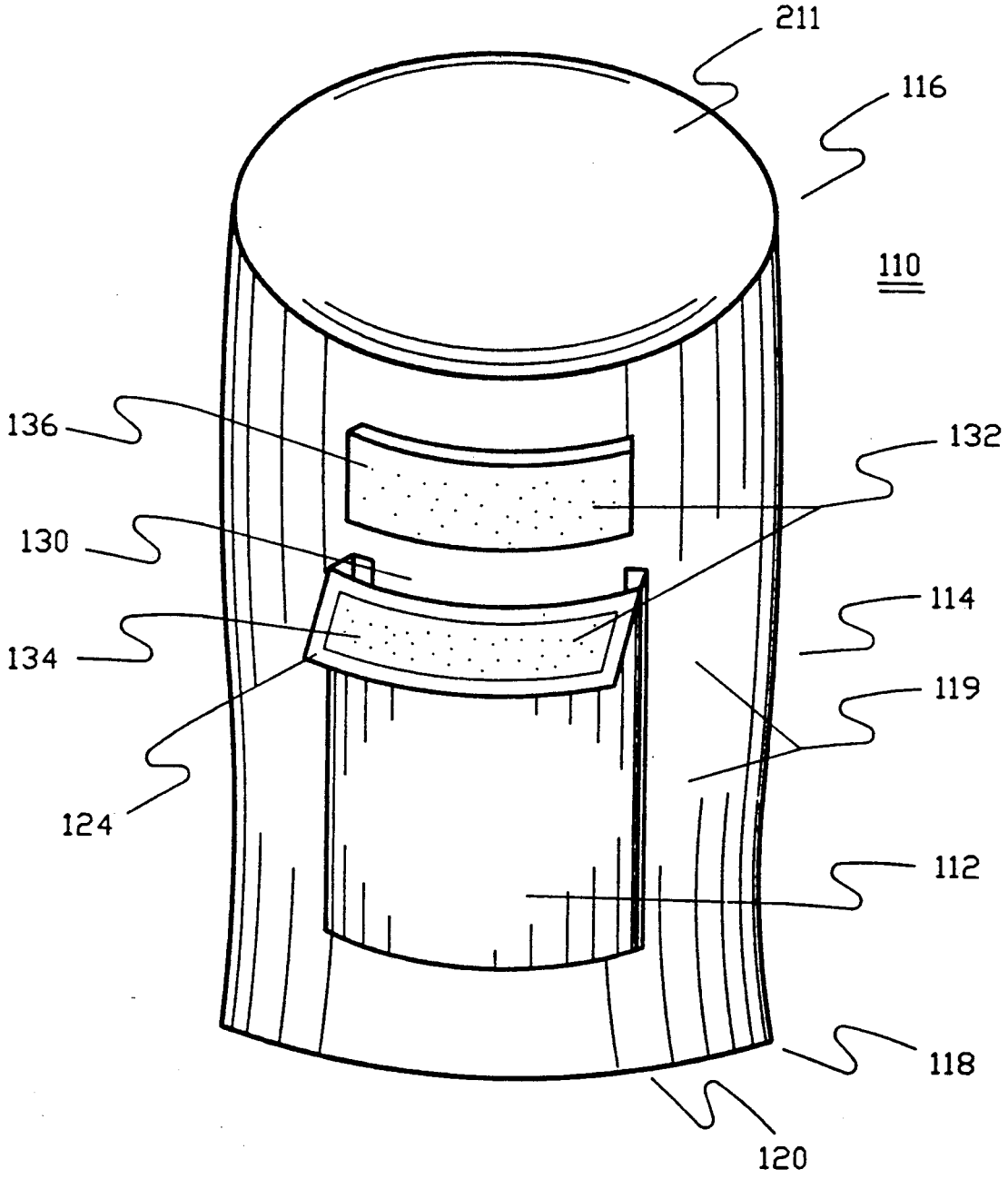
FIG. 4 is a front view of another embodiment of a golf club head cover, the cover being shown with a rectangular pocket positioned on the sleeve of the cover.

Another exemplary embodiment of the present invention is illustrated in FIG. 4. The various elements illustrated in FIGS. 1-3 which correspond to elements described above with respect to the embodiment illustrated in FIGS. 1-3 are designated by corresponding reference numerals increased by one hundred. All additional elements illustrated in FIG. 4 which do not correspond to elements described above with respect to FIGS. 1-3 are designated by reference numerals increased by two hundred. Unless otherwise stated, the embodiment of FIG. 4 operates in the same manner as the embodiment of FIGS. 1-3.

FIG. 4 illustrates a golf club head cover 110 having a pocket 112 and a sleeve 114 which includes a top end 116, a bottom end 118, and a body 119, such that there is a cavity 120 extending through the body 119 from the top end 116 to the bottom end 118. The open cavity 120 permit the insertion of the golf club head into the sleeve 114 and the top end 116 is completely enclosed by an end cap 211 which prevents the sleeve 114 from sliding off the golf club head.

A rectangular pocket 112 having an upper lid 124 is attached to the body 119 of the sleeve 114, such that the an opening 130 is created whereby items can be placed between the pocket 112 and the body 119 of the sleeve 114 and removed therefrom. The upper lid 124 of the pocket 112 is removably attached to the sleeve by a h & l zipper 132, having an upper h & l 134 and a lower h & l 136. The upper h & l 134 is attached to the upper lid 124 of the pocket 112 at the opening 130 and the lower h & l 136 is attached to the body 119 of the sleeve 114 at the opening 130 in the same axial plane as the upper h & l 134, such that the upper h & l 134 can be repeatedly attached and detached from the lower h & l 136, thereby "opening" and "closing" the pocket 112.

OPERATION OF THE INVENTION

A golf club is placed into the golf club head cover 10 when the golf club is not in use by inserting the golf club head into the cavity 20 at the bottom end 18 of sleeve 14 until the head of the golf club abuts the top end 16 of the sleeve 14. Items that are used in combination with golf may be stored in the pocket 12 so that they can be easily and conveniently accessed as they are needed.

To store an item in the pocket 12 it is first necessary to "open" the pocket 12. The h & l zipper 32 is separated by gripping the upper lid 24 of the pocket 12 at the opening 30 with one hand and body 19 of the sleeve 14 with the other hand, and then pulling the upper h & l 34 away from the lower h & l 36. As the upper h & l 34 is separated from the lower h & l 36 the upper lid 24 of the pocket 12 is separated from the lower lid 26 of the pocket 12 thereby allowing items to be passed through the opening 30 to be stored between the upper lid 24 and the lower lid 26. In this position the pocket 12, as shown in FIG. 3, is in the "open" position. After items are placed in the pocket 12, the user attaches the upper h & l 34 back to the lower h & l 36 thereby forming a seal between the upper lid 24 and the lower lid 26 and prohibiting items contained within the pocket 12 from escaping. In this position, as shown in FIGS. 1 and 3, the pocket 12 is in the "closed" position.

Items stored in the pocket 12, remain in the pocket 12 until the user decides to access them by, again, opening the pocket 12 as indicated above.

It will be understood that the embodiments described herein are merely exemplary and that a person skilled in the art may make many variations and modifications without departing from the spirit and scope of the invention. For instance, the size, shape, and location of the pocket 12 on the sleeve 14 can be varied to accomplish the same objectives as achieved under the present embodiment. All such variations and modifications are intended to be included within the scope of the invention as defined in the appended claims.

What is claimed is:

1. A golf club head cover for an individual golf club comprising:

(a) an elongated cylindrical sleeve having a bottom end opened and dimensioned such that the head portion of a single golf club can be extended therethrough and a substantially circular planar top end closed such that the golf club is contained within said sleeve, said sleeve being constructed of flexible material; and (b) a pocket having an upper lid, and a lower lid, said upper lid and said lower lid being attached to said sleeve at the substantially circular top end such that there is an opening between said upper lid and said lower lid permitting insertion of objects between said upper lid and said lower lid and removal of objects contained therebetween.

2. The golf club head cover of claim 1, further comprising closing means for temporarily closing said upper lid of said pocket to said lower lid of said pocket, such that objects contained within said pocket cannot escape from between said upper lid and said lower lid.

3. The golf club head cover of claim 2, wherein said closing means comprises a hook and loop fastener strip.

4. The golf club head cover of claim 2, wherein said pocket is round shaped and approximately the same size as said top end.

5. A golf club head cover for an individual golf club comprising:

(a) an elongated cylindrical sleeve having a bottom end opened and dimensioned such that the head portion of a single golf club can be extended therethrough and a substantially circular planar top end closed such that the golf club is contained within said sleeve, said sleeve being constructed of flexible material; and (b) a pocket, located between said top end of said sleeve and said bottom end of said sleeve, said pocket having an upper lid attached to said sleeve such that there is an opening between said upper lid and said sleeve permitting insertion of objects between said upper lid and said sleeve and removal of objects contained therebetween:

(c) closing means for temporarily closing said upper lid of said pocket to said sleeve, such that objects contained within said pocket cannot escape from between said upper lid and said sleeve.

6. The golf club head cover of claim 5, wherein said closing means comprises a hook and loop fastener strip.

* * * * *